US005335417A

United States Patent [19]

Genero et al.

[11] Patent Number: 5,335,417

[45] Date of Patent: Aug. 9, 1994

[54] HAND RAZOR

[76] Inventors: Claude P. Genero; Gail A. Genero, both of 30 Phillips Street, Dianella, WA 6062, Australia

[21] Appl. No.: 95,672

[22] Filed: Jul. 22, 1993

[30] Foreign Application Priority Data

Jul. 27, 1992 [AU] Australia ..... PL3738
Nov. 2, 1992 [AU] Australia ..... PL5596

[51] Int. Cl.[5] ..... B26B 21/40

[52] U.S. Cl. ..... 30/41.5; 30/90; 30/123.3

[58] Field of Search ..... 30/41, 41.5, 123.3, 30/90

[56] References Cited

U.S. PATENT DOCUMENTS 1,938,481 12/1933 Black ..... 30/41
2,704,397 3/1955 Turgi ..... 30/41 X
4,177,556 12/1979 Galli, Jr. ..... 30/41
4,480,387 11/1984 d'Alayer de Costemore d'Arc ..... 30/41
4,535,537 8/1985 Ferraro et al. ..... 30/41 X

FOREIGN PATENT DOCUMENTS 2129732 5/1984 United Kingdom ..... 30/41.5

*Primary Examiner*—Richard K. Seidel
*Assistant Examiner*—Raymond D. Woods

[57] ABSTRACT

A hand razor comprising a head portion an inlet having an entry end for receiving and delivering water to the head portion to flush a blade supported therein, and an outlet having a discharge end for discharging water from the head portion, the entry and discharge ends being in opposed relation whereby in use water can enter the entry end and leave the discharge end in generally the same direction of flow.

18 Claims, 4 Drawing Sheets

HAND RAZOR

BACKGROUND OF THE INVENTION

The present invention relates to a hand razor.

It is usual to wash the head of a hand razor during and after shaving to remove lather and shaving stubble. This is commonly done by either splashing the head of the razor in water or holding the head of the razor under running water. These procedures are not altogether satisfactory and it is common to find remnants of lather and/or stubble on the blade. The remnants are undesirable not only from the aspect of cleanliness but also because they may contribute to a reduction in the operating life of the blade.

Clearly, there is a need for an improved way of cleaning the blade of a hand razor. One proposal in this regard is disclosed in U.S. Pat. No. 1,938,481 (Black) where there is provided a safety razor having a handle on one end of which there is supported a head assembly comprising a guard and a clamp which co-operate to secure a razor blade therebetween. The handle has a passage extending there through, one end of the passage opening onto the head assembly and the other end of the passage opening on to the free end of the handle. When the razor requires cleaning, it is placed under the outlet spout of a tap with the open end of the handle facing the outlet spout so that water emerging from the outlet spout can enter, and pass along, the passage to the head assembly from where it flows outwardly to flush the blade and the various parts of the head assembly. This arrangement has several deficiencies, one being that it does not clean the blade thoroughly. Another deficiency is that the out-flowing water would undoubtedly spray sideways in various directions, wetting not only the surrounding area but also possibly the user.

SUMMARY OF THE INVENTION

The present invention seeks to provide a razor which eliminates, or at least reduces, the disadvantage referred to above in relation to the earlier proposal.

Broadly, the invention resides in a hand razor comprising a head portion, an inlet having an entry end for receiving and delivering water to the head portion to flush a blade supported therein, and an outlet having a discharge end for discharging water from the head portion, the entry and discharge ends being in opposed relation whereby in use water can enter the entry end and leave the discharge end in generally the same direction of flow.

Typically, the razor would be placed under the outlet spout of a tap associated with a wash basin so that water discharging downwardly from the outlet spout can enter the entry end of the inlet to flush the blade and discharge downwardly from the discharge end into the wash basin. In other words, water enters and leaves the razor in generally the same direction which in the case described is downwardly. This avoids sideways splashing of the water.

The head portion may support a permanent blade or have provision for replacement blades. In the latter case, the replacement blade may be supported in a support structure which is releasably attachable to the head. In such a case, the support structure would have provision for water flow over the blade for flushing purposes. Preferably, the support structure would sealingly engage the head in an effective manner to avoid unintended spraying of water or leakage generally.

Preferably, the head portion is in use associated with a handle which can be integral with the head or detachable therefrom.

A structure may be provided within the head portion for distributing water over the entire blade so that it is flushed properly.

Preferably, portion of the inlet is adapted for engagement with the outlet spout of the tap. For this purpose such engaging portion of the inlet is conveniently defined by a conical formation. The conical formation is advantageous because it can accommodate outlet spouts of various sizes. The conical formation also functions as a guide in that it serves to guide the outlet spout into a position for proper engagement with the inlet as the outlet spout enters the inlet.

The engaging portion of the inlet may be of a construction to facilitate sealing engagement with the outlet spout of the tap so as to avoid water being sprayed outwardly. This construction may be of any suitable form such as the presence of a flexible sealing element in the engaging portion of the inlet or formation of the engaging inlet from resilient material.

It should be appreciated that the inlet can be of any suitable form other than a conical formation, if desired.

Rather than portion of the inlet being adapted for engagement with the outlet spout, there may be a separate structure provided for such purpose. With such an arrangement, the separate structure is detachable from the razor and is adapted for connection to the inlet when attached to the razor. The separate structure may be of elongated construction to accommodate situations in which the outlet spout of the tap is spaced a relatively large distance above the wash basin.

A relief valve mechanism may be provided for releasing excessive water pressure which may arise within the head portion during flushing thereof. The excessive pressure may, for instance, arise as a result of an excessive amount of water being introduced into the head portion or as a result of a blockage.

The relief valve mechanism may be formed integrally with the body of the razor, or may be formed separately and fitted into positions.

The relief valve mechanism may comprise an outlet port which can expand and contract according to the pressure conditions. The outlet port may comprise an aperture with at least one resiliently flexible flap at its periphery, the flap being deflectable under the influence of water pressure to vary the size of the aperture. Conveniently, there are a plurality of such flaps spaced circumferentially around the aperture.

Preferably, the outlet port is so arranged that it discharges water generally in the same direction as the discharge end of the outlet.

The invention will be better understood by reference to the following description of several specific embodiments thereof as shown in the accompanying drawings.

DETAILED DESCRIPTION OF PREFERRED EMBODIMENTS

Figure 1:
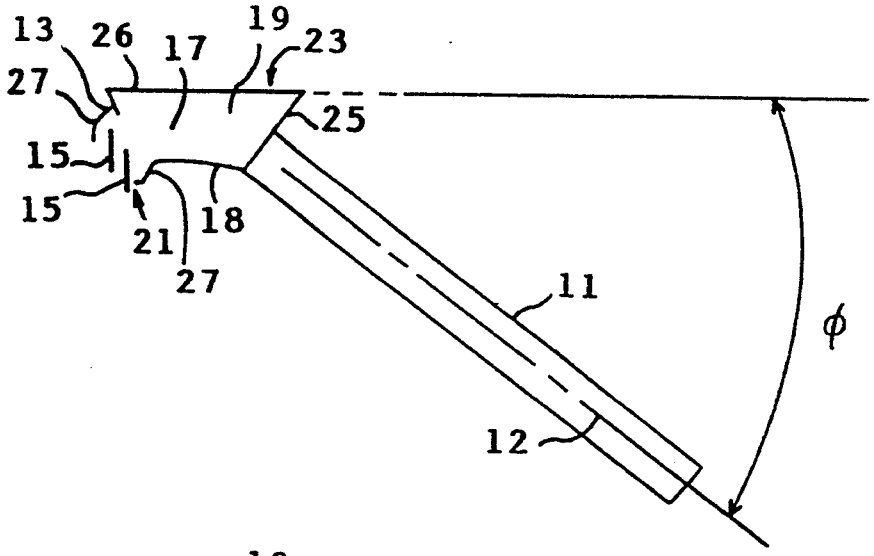
FIG. 1 is a schematic side view of a hand razor according to the first embodiment.

The first embodiment, which is shown in FIGS. 1 to 5 of the accompanying drawings is directed to a hand razor which comprises a handle 11 having a longitudinal axis 12, and a head portion 13 supported at one end of the handle. In this embodiment the handle 11 and head portion 13 are of integral construction but they could well be detachable from one another.

The head portion 13 supports two razor blades 15 positioned in spaced apart relation, as is common practice. Each razor blade 15 comprises a strip of metal having a sharpened edge, the strip being embedded in the head portion. The blades are maintained in spaced apart relationship by a plurality of spacers (not shown) located between the blades at spaced apart relationship at intervals along the length of the blades. The spacers are so constructed as to not impede proper flushing of the blades.

The head portion 13 has an internal cavity 17 which has a bottom wall 18 and which extends along the length of the blades. An inlet 19 is provided for introducing water into the internal cavity 17 and an outlet 21 for discharging water from the internal cavity.

The inlet 19 has an entry end 23 and comprises a conical formation 25 which tapers inwardly from the entry end 23. The conical formation 25 has an outer edge 26.

Figure 2:
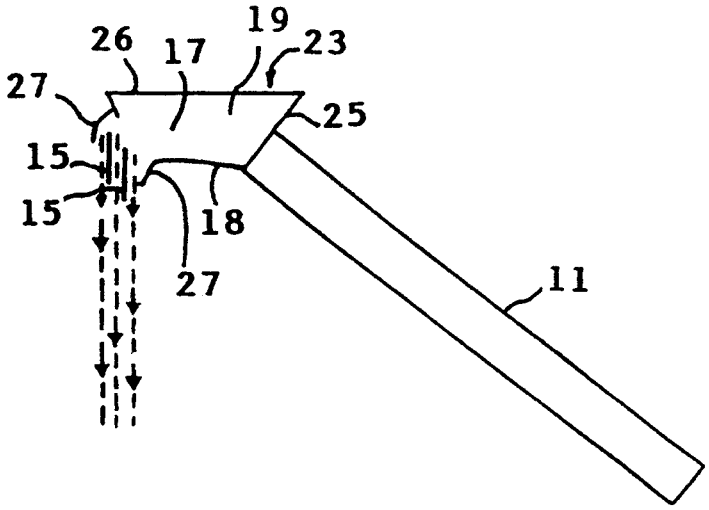
FIG. 2 is a view similar to FIG. 1 with the exception that water is shown flowing over the blades for flushing purposes.
Figure 3:
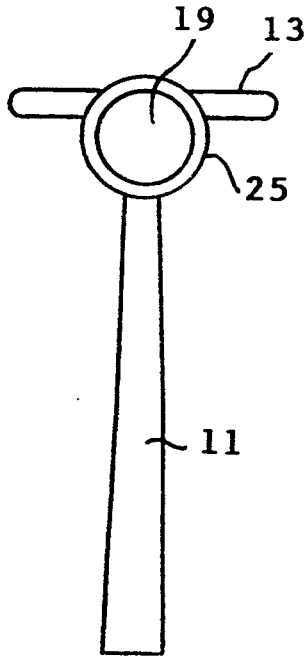
FIG. 3 is a plan view of the hand razor.

The outlet 21 comprises a pair of opposed walls 27 between which the blades 15 are positioned. The walls 27 and the blades 15 co-operate to direct the flow of water discharging through the outlet, as best seen in FIG. 2 of the drawings.

Figure 4:
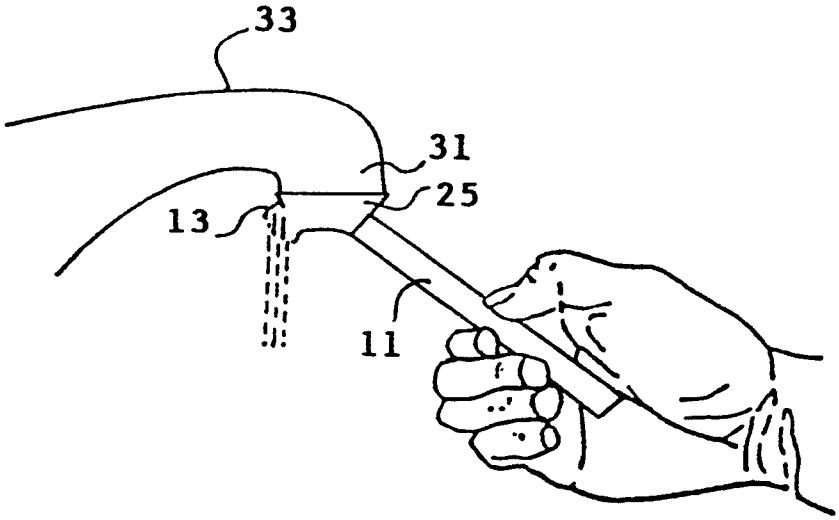
FIG. 4 illustrates the razor according to the embodiment in one manner of use.
Figure 5:
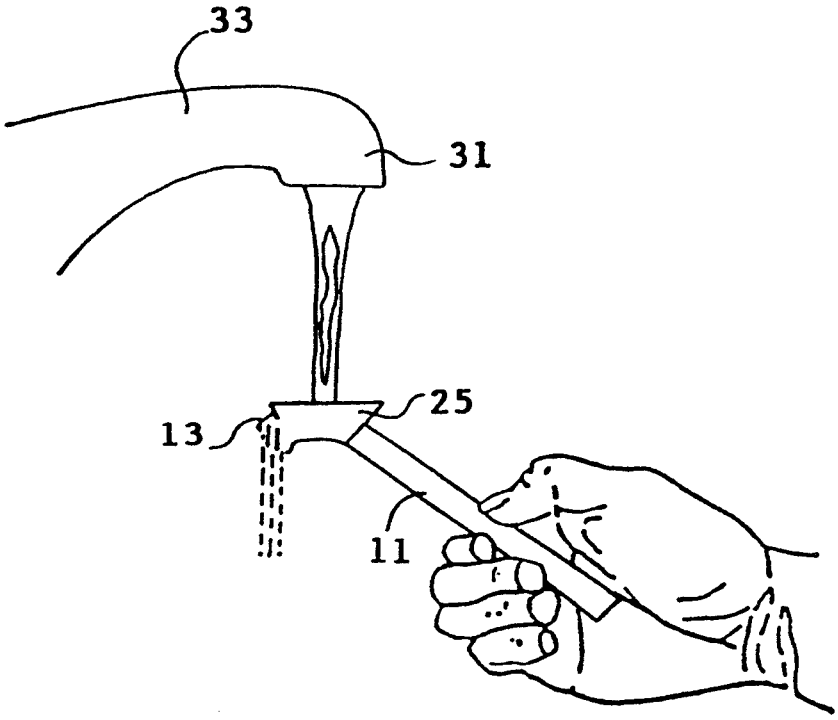
FIG. 5 illustrates the razor according to the embodiment in another manner of use.

The construction of the razor is such that the blades 15 can be conveniently flushed to remove lather and shaving stubble without excessive splashing. In this regard, the inlet 19 is adapted to receive a flow of water either by positioning the inlet in engagement with the outlet spout 31 of a tap 33 (as shown in FIG. 4) or by holding the inlet 19 under a flow of water emerging from the outlet spout of the tap (as shown in FIG. 5). In each case, water enters the interior cavity 17 through the inlet and then flows over the blades 15 to discharge from the outlet 21. The water discharges from the outlet 21 in generally the same direction as water enters the inlet 19. The water discharging from the outlet is offset with respect to the water entering the inlet but nevertheless is flowing in generally the same direction. This is best seen in FIG. 5 of the drawings.

The conical formation of the inlet 19 is advantageous because it allows the inlet to engage outlet spouts of various sizes in circumstances where the user wishes to engage the inlet with the outlet spout as is shown in FIG. 4. The conical formation also is advantageous when the razor is used in the manner illustrated in FIG. 5 because it acts as a funnel for the water as it enters the inlet.

It has been found that the razor operates best in terms of its shaving performance when the angle $\phi$ (see FIG. 1) between the outer edge 26 of the conical formation and the longitudinal axis 12 of the handle is in the range of about 30° to 35°.

While the razor according to the first embodiment is of simple construction it is particularly useful for the reason that water discharges from the outlet in generally the same direction as water enters the inlet. The benefit of this is that the water is not sprayed sidewardly to wet the surrounding area and possibly the user.

Figure 6:
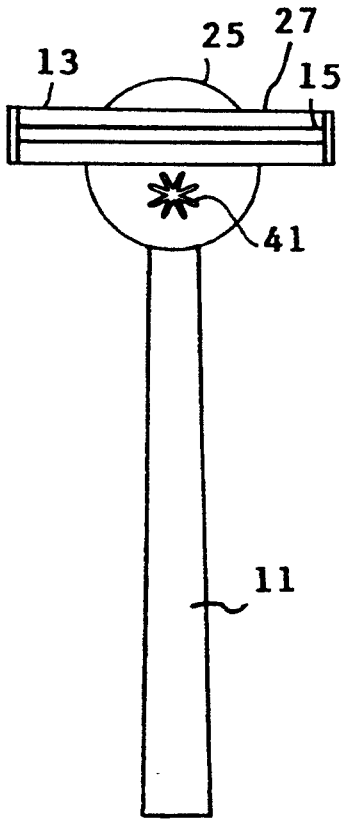
FIG. 6 is a schematic underside view of a razor according to a second embodiment.
Figure 7:
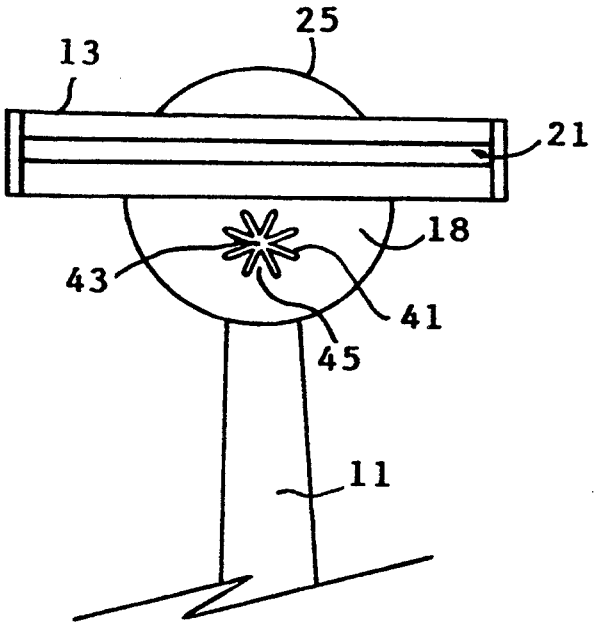
FIG. 7 is a fragmentary view of the razor of FIG. 6.
Figure 8:
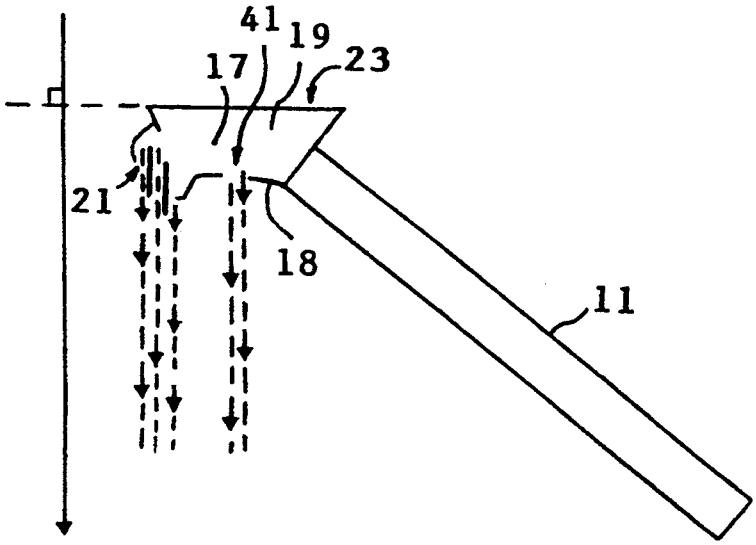
FIG. 8 is a schematic side view of the razor according to the second embodiment, illustrating water flowing over the blades for flushing purposes and water discharging through a relieve valve incorporated within the razor.

The second embodiment, which is shown in FIGS. 6, 7 and 8 of the accompanying drawings, is similar to the first embodiment with the exception that a pressure relief valve 41 is incorporated on the bottom wall 18 of the cavity 17 within the head portion. The purpose of the pressure relief valve is to relieve any excessive water pressure which may arise in the cavity 17. The relief valve 41 comprises a port 43 formed in the bottom wall 18, the port comprising an aperture provided with a plurality of circumferentially spaced flaps 45 around its periphery. The flaps 45 are resiliently flexible and can deflect under the influence of water pressure to vary the size of the aperture. Accordingly, when there is excessive pressure within the cavity 17, the flaps 45 are deflected outwardly to increase the size of the aperture and so allow water to escape there through to provide pressure relief. The positioning of the outlet port on the underside of the head portion is significant in that it ensures that water discharges from the port in generally the same direction as water discharging from the outlet 21. This also avoids excessive splashing of water.

Figure 9:
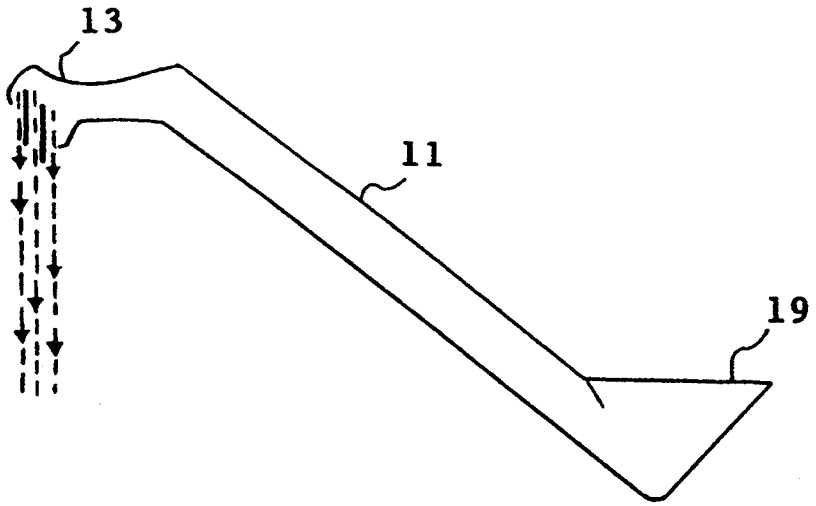
FIG. 9 is a schematic side view of a razor according to a third embodiment.

The third embodiment, which is shown in FIG. 9, is somewhat similar to the earlier embodiments, with the exception that the inlet 19 is remote from the head portion 13. In particular, the inlet 19 is at the end of the handle 11 opposite to the head portion. A water flow passageway (not shown) extends through the handle between the inlet 19 and the head portion 13.

Figure 10:
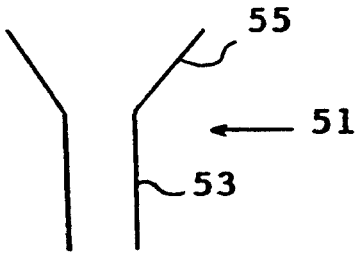
FIG. 10 is a schematic view of a separate structure for use with a razor according to a fourth embodiment.

The fourth embodiment is directed to a razor in which a separate structure is provided for engagement with the outlet spout of a tap. The separate structure is illustrated in FIG. 10 and comprises a fitting 51 in the form of a rigid tube 53 one end of which has a conical formation 55. The other end of the tube 53 is releasably engagable with an inlet provided in the razor such that water entering the tube 53 through the conical formation can be delivered to the inlet in the razor from where it is conveyed to the head for the purposes of flushing the or each blade of the razor. With this arrangement, the expense of forming the conical formation integrally with the razor is avoided. The user would simply have one fitting and use it as required with successive razors. Alternatively, such a fitting may be supplied with each razor.

It should be appreciated that the scope of the invention is not limited to the scope of the embodiments described.

What is claimed is:

1. A hand razor comprising a head portion, an inlet having an entry end for receiving and delivering water to the head portion to flush a blade supported therein, and an outlet having a discharge end for discharging said water from the head portion, the entry end having an engaging portion for engaging an outlet spout of a tap, said engaging portion comprising means for sealingly engaging with the outlet spout of the tap, the entry and discharge ends being integral with and fixed in relation to each other and being in opposed relation whereby in use water enters the entry end and leaves the discharge end in generally the same direction of flow.

2. A hand razor as claimed in claim 1 wherein the blade is a permanent blade.

3. A hand razor as claimed in claim 1 wherein the head portion has means for releasably supporting the blade.

4. A hand razor as claimed in claim 1 wherein the head portion is supported on a handle.

5. A hand razor as claimed in claim 1 wherein the head portion has an internal cavity which extends along a length of the blade.

6. A hand razor as claimed in claim 1 wherein the engaging portion of the inlet is defined by a conical formation.

7. A hand razor as claimed in claim 1 wherein said means for sealingly engaging comprises a flexible sealing element in the engaging portion of the inlet.

8. A hand razor as claimed in claim 1 wherein said means for sealingly engaging comprises said engaging portion being formed of resilient material.

9. A hand razor as claimed in claim 1 wherein the outlet comprises a pair of opposed walls between which the blade is positioned, the walls and the blade cooperating to control the direction of flow of water discharging from the head portion.

10. A hand razor as claimed in claim 1 further comprising a separate structure provided for engagement with the outlet spout of the tap for delivery of the water to the inlet of the hand razor, the separate structure being detachable from the razor.

11. A hand razor as claimed in claim 1 further comprising a relief valve mechanism for releasing excessive water pressure within the head portion during flushing thereof.

12. A hand razor as claimed in claim 11 wherein the relief valve mechanism comprises an outlet port capable of expanding and contracting according to pressure conditions within the head.

13. A hand razor according to claim 12 wherein the outlet port comprises an aperture with at least one resiliently flexible flap at its periphery, the flap being deflectable under the influence of water pressure to vary the size of the aperture.

14. A hand razor according to claim 13 wherein there are a plurality of said flaps spaced peripherally around the aperture.

15. A hand razor according to claim 12 wherein the outlet port is so arranged that it discharges water generally in the same direction as the discharge end of the outlet.

16. A hand razor as claimed in claim 1 wherein the head portion is elongated and has an internal cavity extending substantially along the length thereof, said inlet and said outlet being in communication with said cavity.

17. A hand razor comprising a head portion, an inlet having an entry end for receiving and delivering water to the head portion to flush a blade supported therein, and an outlet having a discharge end for discharging water form the head portion, the entry end having an engaging portion for engaging an outlet spout of a tap, said engaging portion comprising means for receiving the outlet spout of the tap, the entry and discharge ends being integral with and fixed in relation to each other and being in opposed relation whereby in use water enters the entry end and leaves the discharge end in generally the same direction of flow.

18. A hand razor comprising a head portion, a single inlet for receiving and delivering water to the head portion to flush a blade supported therein, and an outlet for discharging water from the head portion, the inlet having a peripheral engaging portion with means for engaging an entire periphery of an outlet spout of a tap, the inlet and the outlet being integral with and fixed in relation to each other and being in opposed relation whereby in use water enters the inlet and leaves the outlet in generally the same direction of flow.

* * * * *